US010965015B2

(12) United States Patent
Walton

(10) Patent No.: US 10,965,015 B2
(45) Date of Patent: Mar. 30, 2021

(54) PORTABLE PROTECTIVE ENCLOSURE FOR COMMUNICATIONS DEVICES

(71) Applicants: William D. Walton, Pinon Hills, CA (US); W. B. Walton Enterprises, Inc., San Bernardino, CA (US)

(72) Inventor: William D. Walton, Pinon Hills, CA (US)

(73) Assignee: W. B. Walton Enterprises, Inc., San Bernardino, CA (US)

( * ) Notice: Subject to any disclaimer, the term of this patent is extended or adjusted under 35 U.S.C. 154(b) by 0 days.

(21) Appl. No.: 16/403,305

(22) Filed: May 3, 2019

(65) Prior Publication Data

US 2019/0341684 A1 Nov. 7, 2019

Related U.S. Application Data

(60) Provisional application No. 62/666,453, filed on May 3, 2018.

(51) Int. Cl.
*H01Q 1/42* (2006.01)
*H01Q 1/02* (2006.01)

(52) U.S. Cl.
CPC ..... *H01Q 1/42* (2013.01); *H01Q 1/02* (2013.01)

(58) Field of Classification Search
CPC . H01Q 1/02; H01Q 1/42; H01Q 19/12; E04H 15/28; E04H 15/34; E04H 15/36
See application file for complete search history.

(56) References Cited

U.S. PATENT DOCUMENTS

| | | | | |
|---|---|---|---|---|
| 4,136,408 | A | 1/1979 | Dahlbeck et al. | |
| 2002/0184833 | A1 | 12/2002 | Jones | |
| 2009/0262033 | A1* | 10/2009 | King | H01Q 19/12 343/713 |

FOREIGN PATENT DOCUMENTS

| | | | |
|---|---|---|---|
| DE | 4330224 | A1 | 3/1995 |
| EP | 0043762 | A1 | 1/1982 |
| FR | 1163844 | A | 10/1958 |

OTHER PUBLICATIONS

"Radomes", L3 Technologies, Inc., http://www2.l3t.com/esco/radomes/index.htm, available prior to May 3, 2018, https://web.archive.org/web/20170801000000*/http://www2/l3t.com/essco/radomes/index.htm.

(Continued)

*Primary Examiner* — Monica C King
(74) *Attorney, Agent, or Firm* — Knobbe, Martens, Olson & Bear, LLP

(57) ABSTRACT

A modular antenna enclosure is disclosed. The modular antenna enclosure includes a frame structure, a base structure including side plates, a capturing member and a frame structure. The frame structure includes vertical support members extending between the capturing member located near the top of the modular antenna enclosure and the side plates of the base structure. Each of the side plates of the base structure is coupled to adjacent side plates via a connector assembly that includes a vertical receptor to receive the vertical support members of the frame structure. The connector assembly can include a securing member that allows users to secure the base structure to a surface below.

20 Claims, 10 Drawing Sheets

(56) References Cited

OTHER PUBLICATIONS

4k Solutions, Defender 10_4K USAF Demo2, https://4ksolutions.com/4k-demonstrates-element-armour-portable-vsat-radomes/, available prior to May 3, 2018, https://web.archive.org/web/20170925092509 3511/https://4ksolutions.com/4k-demonstrates-element-armour-portable-vsat-radomes/.
HDT Global, "HDT Airbeam® Radome Shelters, Rapidly Deploying, Expeditionary RaDome", 2015.
InfiniteRCS Technologies, Inc., "Radomes & Composite Structures", https://compositeradomes.com/radomes, available prior to May 3, 2019, https://web.archive.org/web/20181223213409/http://compositeradomes.com/radomes/.
International Search Report and Written Opinion issued in application No. PCT/US2019/030624.
Invitation to Pay fees with Partial International Search Report issued in application No. PCT/US2019/030624 dated Aug. 6, 2019.
MWT Materials Inc., Providing RF Control Solutions, MAS-300 Series RF Absorbers, Ver 4.1, pp. 1-2, available prior to May 3, 2018.

* cited by examiner

PORTABLE PROTECTIVE ENCLOSURE FOR COMMUNICATIONS DEVICES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered as a part of this specification.

BACKGROUND

Field

Aspects of the present disclosure relate to antenna enclosures and, in particular, a portable antenna enclosure that is modular, easy to assemble, and capable of withstanding high winds.

Description of the Related Art

Satellite communications and other communications often require the use of dish antennas to both receive and transmit signals. At certain frequencies, the signals being received or transmitted can become degraded if there is an accumulation of sand, snow, ice or water on the dish of the antenna. As such, there are designs for covers that inhibit the accumulation of sand, water, snow and ice on the dish of the antenna so as to improve the performance of the antenna. The cover also protects the antenna's reflector from sun light which could distort the reflective surface and cause attenuation.

Often these designs are suited for very large antennas and not as suited for smaller antennas such as those having a diameter of less than 15 feet. These designs often are fully formed structures which are not very portable, making them unsuitable for use of more portable antennas. It will be appreciated that smaller antennas may have to be moved from location to location in particular applications.

Some designs for smaller antennas use forced air to maintain the cover's position over the antenna, which is can be costly in terms of the electricity consumption to provide the continuous air supply. Further, many existing designs are not particularly wind resistant and are thus unsuited for use in harsher environments. Other existing designs may also not be suited for particular frequency bands.

From the foregoing, there is a need for a portable antenna enclosure that is easy to transport, suited for adaption for use on smaller antennas, and capable of withstanding high winds.

SUMMARY

The foregoing needs are satisfied, in at least some arrangements of the enclosure of the present disclosure, which can have a sectional base comprised of a plurality of reinforced sections that are connected together to form an enclosed space. The base can include guide channels that receive vertical support members formed of a flexible material. The vertical support members are bendable inward and can be captured by an upper receiving block that is positioned over the approximate center of the enclosed space defined by the sectional base. A cover, such as a fabric or polymer cover is then positioned over the vertical support members such that the enclosed space defined by the sectional base, the vertical support members and the cover is suitable for receiving a dish type antenna.

In any arrangements, the cover disclosed herein can have a material that inhibits water from passing through the cover, but does not substantially inhibit the transmission of signals to and from the antenna. In one non-limiting example, the cover can be made from a PTFE fabric. In arrangements, including arrangements wherein the cover is made from PTFE, the cover can be coated with PTFE for additional sealing and/or protection.

The cover can be, in any arrangements, secured to the reinforcing sections so as to inhibit the cover from being blown off due to wind. In some arrangements, the cover can include loops that receive a strap. In some arrangements, including arrangements wherein the cover includes loops that receive a strap, the strap can then be cinched against the reinforcing sections to inhibit the cover from being blown off the reinforcing section.

These and other objects and advantages of the present invention will become more apparent from the following description taken in conjunction with the accompanying drawings.

Any of the arrangements disclosed herein can have any or any combination of any of the components, features, or details of any of the following arrangements.

Arrangement 1: A portable antenna enclosure for a communications antenna. The portable antenna enclosure can include a cover configured to form a complete above-ground enclosure around a communications antenna when the enclosure is in an assembled state. The portable antenna enclosure can include a modular frame configured to support the cover out of contact with a communications antenna positioned within the enclosure in the assembled state, where the modular frame can be positioned inside of the cover in the assembled state. The modular frame can include a plurality of upper support members that can support an upper portion of the enclosure in the assembled state. The modular frame can include a hub that can couple with an end portion of each of the plurality of upper support members. The hub can be positioned at an upper portion of the enclosure in the assembled state. The modular frame can include a plurality of lateral support members that can extend around a perimeter of a portion of the enclosure in an assembled state. The modular frame can include a plurality of shield elements that can cover at least an inward facing surface of at least one of the plurality of upper support members, the plurality of lateral support members, and the hub. A lower portion of the frame can rest on a support surface when the enclosure is in an assembled state. The plurality of shield elements can reduce an amount of radio-frequency signal reflectable by at least one of the plurality of upper support members, the plurality of lateral support members, and the hub when the enclosure is in the assembled state.

Arrangement 2: The antenna enclosure of Arrangement 1, wherein the upper support members are made from a resilient, flexible material and are configured to be supported in a bent state when the frame is in the assembled state.

Arrangement 3: The antenna enclosure of any of the previous Arrangements, wherein the lateral support members extend between the upper support members when the enclosure is in the assembled state.

Arrangement 4: The antenna enclosure of any of the previous Arrangements, wherein the lateral support members are positioned generally at a middle portion of a height of the frame.

Arrangement 5: The antenna enclosure of any of the previous Arrangements, wherein the frame further comprises a plurality of support panels positioned in a circumferential arrangement in a lower portion of the frame in an assembled state, the plurality of support panels being configured to increase the structural stability of the frame.

Arrangement 6: The antenna enclosure of any of the previous Arrangements, wherein the frame further comprises a means for coupling the plurality of support panels together and to the frame.

Arrangement 7: The antenna enclosure of any of the previous Arrangements, wherein a lower portion of the frame comprises a plurality of interconnected support panels in a circumferential arrangement.

Arrangement 8: The antenna enclosure of any of the previous Arrangements, wherein the cover is configured to permit a near complete transmission of a communications signal through the cover such that the communications antenna is highly efficient in transmitting the communications signal through the cover even when the cover completely encloses the communications antenna.

Arrangement 9: The antenna enclosure of any of the previous Arrangements, wherein the cover is made from polytetrafluoroethylene.

Arrangement 10: The antenna enclosure of any of the previous Arrangements, wherein the plurality of shield elements comprise a material configured to suppress near field microwave surface currents over a frequency range of 0.01 to 16 GHz.

Arrangement 11: The antenna enclosure of any of the previous Arrangements, wherein the frame comprises a means for coupling the upper support members to the lateral support members.

Arrangement 12: The antenna enclosure of any of the previous Arrangements, further comprising a means for coupling the frame to a ground surface.

Arrangement 13: The antenna enclosure of any of the previous Arrangements, further comprising a means for coupling the cover with the frame.

Arrangement 14: The antenna enclosure of any of the previous Arrangements, wherein the frame further comprises one or more connectors configured to tether with a plurality of support lines.

Arrangement 15: The antenna enclosure of any of the previous Arrangements, wherein the cover comprises a plurality of loops configured to receive a strap, the strap being configured to tighten the cover against an outside surface of the frame.

Arrangement 16: The antenna enclosure of any of the previous Arrangements, wherein the cover comprises a plurality of fasteners configured to removably secure the cover to the frame.

Arrangement 17: The antenna enclosure of any of the previous Arrangements, wherein the hub comprises a plurality of radially oriented openings configured to receive an end portion of the plurality of upper support members.

Arrangement 18: The antenna enclosure of any of the previous Arrangements, further comprising an environment control unit configured to prevent a formation of ice on an outer surface of the cover.

Arrangement 19: The antenna enclosure of any of the previous Arrangements, wherein the enclosure is configured to be assembled without a use of any tools.

Arrangement 20: The antenna enclosure of any of the previous Arrangements, further comprising a base member positionable under the frame in the assembled state.

Arrangement 21: The antenna enclosure of any of the previous Arrangements and a communications antenna.

Arrangement 22: An antenna enclosure having a frame and a cover. The frame can include a hub having a plurality of openings, a plurality of side plates, a plurality of side plate connectors, a plurality of lower support members, and a plurality of upper support members. The plurality of side plate connectors can each be positioned between each of the plurality of side plates and be configured to selectively couple the plurality of side plates together when the enclosure is in an assembled state. Each of the plurality of lower support members can have a first end coupled with each of the plurality of connectors and a second end coupled with each of a plurality of support member connectors when the enclosure is in the assembled state. Each of the plurality of upper support members can have a first end coupled with each of the plurality of support member connectors and a second end coupled with each of the plurality of openings of the hub when the enclosure is in the assembled state. The cover can be configured to cover the frame and to form a complete enclosure around an antenna.

Arrangement 23: The antenna enclosure of Arrangement 22, wherein each of the side plates comprises a rigid flat panel and a rigid elongated member coupled to the flat panel, and wherein the elongated element of each side plate is configured to couple with each of the plurality of connectors.

Arrangement 24: The antenna enclosure of any of the Arrangements 22-23, wherein the frame structure further comprises the plurality of lateral support members extending between adjacent vertical support members.

Arrangement 25: An antenna cover having a capture member including a plurality of openings, a base structure, a frame structure, a plurality of wraps, and a cover. The base member can include a first side plate having a first panel and a first tubular member positioned along a length of the first side plate. The base member can include a second side plate comprising a second panel and a second tubular member positioned along a length of the second side plate, the second side plate positioned adjacent to the first side plate. The base member can include a first stand positioned between the first side plate and the second side plate. The cover can be draped over the frame structure. The cover can be made with RF absorbent material that can reduce the amount of RF reflected by the cover.

In any arrangements, including without limitation Arrangement 25, the first stand can include a receptor, and a plurality of fasteners, a first fastener of the plurality of fasteners configured to couple with the first tubular member, a second fastener of the plurality of fasteners configured to couple with the second tubular member. The first stand can include a securing member.

In any arrangements, including without limitation Arrangement 25, the frame structure can include a plurality of vertical support members. A first vertical support member of the plurality of vertical support members can include a first end coupled to the receptor of the first stand and a second end coupled to a corresponding opening of the plurality of openings of the capture member. The plurality of vertical supports can be in arcuate orientation between the vertical receptor and the capture member. The frame structure can include a plurality of horizontal support members extending between adjacent vertical support members.

In any arrangements, including without limitation Arrangement 25, the plurality of wraps can have radio-frequency (RF) signal absorbing properties. The plurality of warps can reduce an amount of RF signal reflected by the plurality of vertical support members and the plurality of horizontal support members. The plurality of wraps can be applied at least to the plurality of vertical support members and a plurality of horizontal support members.

Arrangement 26: The antenna cover of Arrangement 25, wherein the plurality of fasteners of the first stand further include a corresponding plurality of tensioners. The plurality of tensioners can secure one of the plurality of vertical support members to the vertical receptor. The plurality of tensioners can secure the first fastener to the first tubular member and secure the second fastener to the second tubular member.

Arrangement 27: The antenna cover of any of the Arrangements 25-26, wherein the first fastener includes a first aperture and a first locking pin and the second fastener includes a second aperture and a second locking pin. The first tubular member includes a first opening and the second tubular member includes a second opening. The first aperture and the first opening are vertically aligned to allow the first locking pin to extend through both the first aperture and the first opening, the first locking pin thereby removably coupling the first fastener of the first stand and the first tubular member of the first side plate. The second aperture and the second opening are vertically aligned to allow the second locking pin to extend through both the second aperture and the second opening, the second locking pin thereby removably coupling the second fastener of the first stand and the second tubular member of the second side plate.

Arrangement 28: The antenna cover of any of the Arrangements 25-27, wherein the securing member is coupled to a bottom portion of the first stand. The securing member can allow the first stand to be secured to a surface below.

Arrangement 29: The antenna cover of any of the Arrangements 25-28, the securing member includes a plurality of openings.

Arrangement 30: The antenna cover of any of the Arrangements 25-29, the first stand further including one or more eye bolts that can tether with a plurality of support lines.

Arrangement 31: The antenna cover of any of the Arrangements 25-30, wherein the cover includes a plurality of loops that can receive a belt, and wherein the cover can be cinched against the base structure via the belt.

Arrangement 32: The antenna cover of any of the Arrangements 25-31, wherein the cover includes a plurality of fasteners that can removably secure the cover to the plurality of vertical supports of the frame structure.

Arrangement 33: The antenna cover of any of the Arrangements 25-32, wherein the cover further includes an environment control unit. The environment control unit can prevent formation of ice on an outer surface of the cover.

Arrangement 34: An antenna cover can include a capture member, a base structure, a frame structure, and a cover. The capture member can include a plurality of openings. The base structure can include a first side plate, a second side plate adjacent to the first side plate; and a first stand. The first stand can be positioned between the first side plate and the second side plate. The first stand can include a receptor and a plurality of fasteners that can couple with the first side plate and the second side plate. The frame structure can include a plurality of vertical support members. Each of the plurality of vertical support members can include a first end coupled to the vertical receptor of the first stand and a second end coupled to a corresponding opening of the plurality of openings of the capture member. The cover can cover the frame structure.

Arrangement 35: The antenna cover of Arrangement 34, wherein the first side plate can include a first panel and a first tubular member coupled to a side of the first panel. The second side plate can include a second panel and a second tubular member coupled to a side of the second panel. The first tubular member and the second tubular member can couple with the plurality of fasteners to secure the first side plate and the second side plate to the first stand.

Arrangement 36: The antenna cover of any of the Arrangements 34-35, wherein the first side plate can include a first panel and a first tubular member coupled to a side of the first panel. The second side plate can include a second panel and a second tubular member coupled to a side of the second panel. The first tubular member and the second tubular member can couple with the plurality of fasteners to secure the first side plate and the second side plate to the first stand.

Arrangement 37: The antenna cover of any of the Arrangements 34-36, wherein the frame structure further comprises the plurality of horizontal support members extending between adjacent vertical support members Arrangement 38: The antenna cover of any of the Arrangements 34-37, the first stand further including a securing member coupled to a bottom portion of the first stand, the securing member configured to allow the first stand to be secured to a surface.

Arrangement 39: The antenna cover of any of the Arrangements 34-38, wherein the securing member comprises a plurality of openings.

Arrangement 40: The antenna cover of any of the Arrangements 34-39, the antenna cover further comprising wraps for the plurality of vertical support members and the plurality of horizontal support members.

Arrangement 41: The antenna cover of any of the Arrangements 34-40, wherein the wraps are made of radio frequency (RF) absorbent material, and wherein the wraps can prevent reflection of RF off of the plurality of vertical support member and the plurality of horizontal support members.

Arrangement 42: The antenna cover of any of the Arrangements 34-41, wherein the cover can include a plurality of loops that can receive a belt, and wherein the cover can be cinched against the base structure via the belt.

Arrangement 43: The antenna cover of any of the Arrangements 34-42, wherein the cover includes a plurality of fasteners that can removably secure the cover to the plurality of vertical supports of the frame structure.

DETAILED DESCRIPTION

Figure 1:
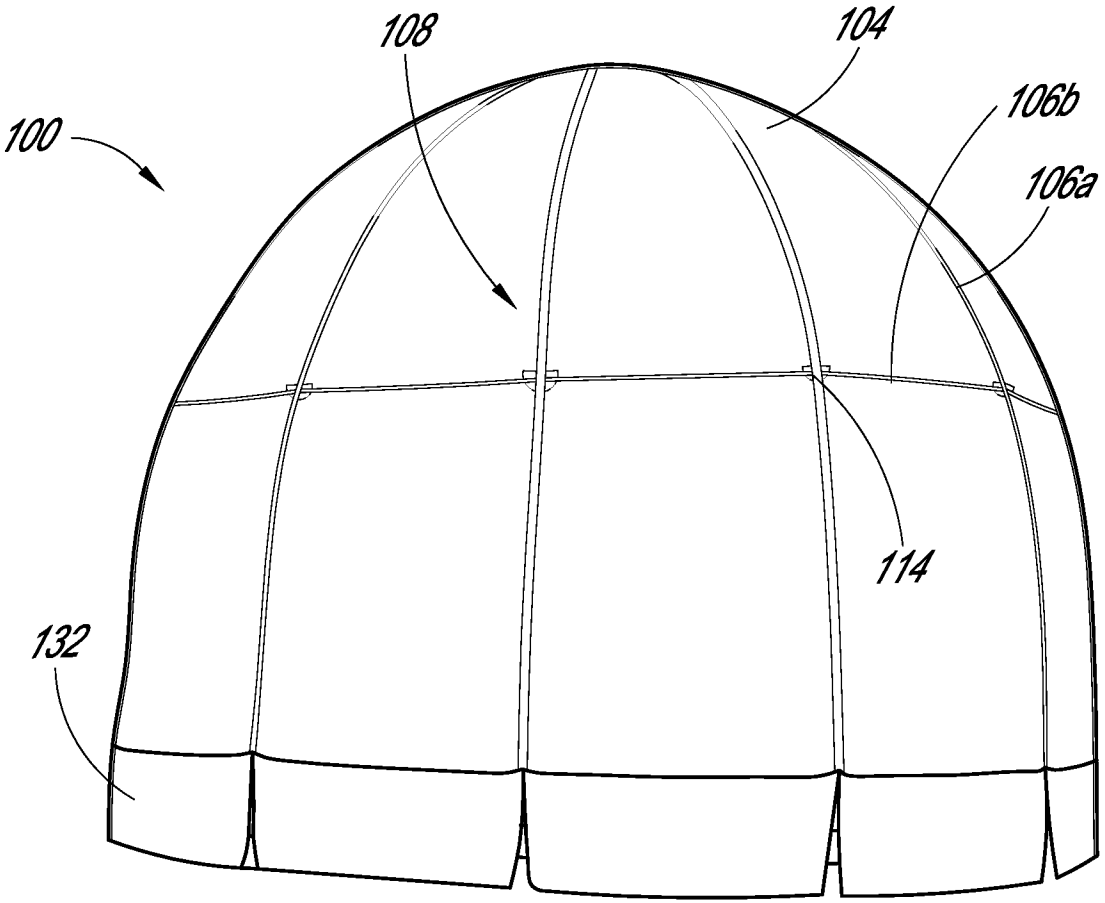
FIG. 1 is a perspective view of the outside of an assembled portable, modular antenna enclosure of the instant application.

Reference will now be made to the drawings wherein like numerals refer to like parts throughout. Referring initially to FIG. 1, a portable, modular antenna enclosure 100 is shown. As shown, the modular antenna enclosure 100 can include base stands 126, side plates 124, a cover 104, horizontal support members 105, upper vertical support members 106, and lower vertical support members 107 that define a frame structure 108. In any arrangements disclosed herein, the lower vertical support members 107 can be mounted on the base stands 126 and extend upward. The lower vertical support members 107 can be coupled to the upper vertical support members 106 that can extend upwardly and inwardly to a capture member 118 (see FIG. 3) (also referred to as a hub herein) so as to define a three dimensional space. The horizontal support members 105 can be positioned between the vertical support members 106, 107 to provide additional structural support. The cover 104 can be coupled with and be selectively secured to the frame structure 108, as well as to the base stands 126. The modular antenna enclosure 100 can include but is not required to include horizontal support members 105. The horizontal support members 105 can be included so as to provide additional structural support to the frame structure 108. Optionally, the horizontal and vertical support members 105, 106, 107 can be coupled via connectors 114. The connectors 114 can be slidably coupled to the vertical support members 106, 107 and the horizontal support members 105. In some arrangements, the connectors 114 can be integrated to the upper vertical support members 106 or the lower vertical support members 107, or both. Optionally, the connectors 114 can be modular.

Any aspects of the frame structure 108 can include the support members 105, 106, 107 made of plastic, ABS, fiber based composite materials, PTFE, any combinations of the forgoing and/or any other suitable materials that are lightweight yet rigid and strong. In some arrangements, the support members 105, 106, 107 can be made out of fiberglass, carbon fiber, and the like. The vertical support members 106, 107 can be between approximately 25 inches and approximately 140 inches in length. In some arrangements, the vertical support members 106, 107 can be between approximately 30 inches and approximately 85 inches in length. The horizontal support members 105 can be between approximately 25 inches and approximately 30 inches in length. The support members 105, 106, 107 can be approximately 0.625 inches in diameter, or optionally between approximately 0.5 inches and approximately 1 inch in diameter. The support members 105, 106, 107 can be flexible and resilient, and can be bent into the shape shown in FIGS. 1 and 2. The dimensions (for example, length and diameter) of the support members 105, 106, 107 can be varied to provide modular antenna enclosures 100 in different sizes. In some arrangements, the support members 105, 106, 107 can be made of fiberglass to provide adequate rigidity and flexibility.

Optionally, the lower vertical support members 107 and the upper vertical support members 106 can be same or differ in length. In some arrangements, the upper vertical support members 106 can be between approximately 60 inches and approximately 100 inches in length, while the lower vertical support members 107 can be between approximately 20 inches and approximately 45 inches in length. In any arrangements described herein, the upper vertical support members can be about 81 inches in length. In any arrangements described herein, the lower vertical support members can be about 34 inches in length.

Optionally, the support members 105, 106, 107 can be shielded to prevent reflection of RF signal. In some arrangements, all the vertical support members 106, 107 can be shielded to prevent reflection of RF signal transmitted to and from an antenna housed within the modular antenna enclosure 100. In other arrangements, all horizontal support members 105 and the upper vertical support members 106 positioned above the sleeves 112 (or the connectors 114) can be shielded. This can advantageously allow the antenna to have a 360 degree range in azimuth. In some arrangements, the support members 105, 106, 107 facing or adjacent to the front of the antenna (that is, the portion of the antenna that receives/transmit RF signal) can be shielded while the support members 105, 106, 107 facing the rear of the antenna (that is, the portion of the antenna that does not receive/transmit RF signal) are not shielded. The support members 105, 106, 107 and the capturing member 118 can include indicators (for example, colors, letters, and/or numbers) to allow users to know which support members are shield and which are not. Additionally and/or alternatively, the indicators can allow users to know where shielded support members go and where non-shielded support members go.

In any arrangements, the upper and lower vertical support members 106, 107 can be coupled in series. Optionally, the upper and lower vertical support members 106, 107 can be coupled via the connectors 114 or sleeves 112. As discussed above, the horizontal support members 105 can be coupled to the connectors 114 along with the one or more vertical support members 106, 107. Optionally, the vertical support members 106 can be integrated into or monolithically formed with vertical support members 107 that extend from the base stands 126 to the capture member 118.

Figure 2:
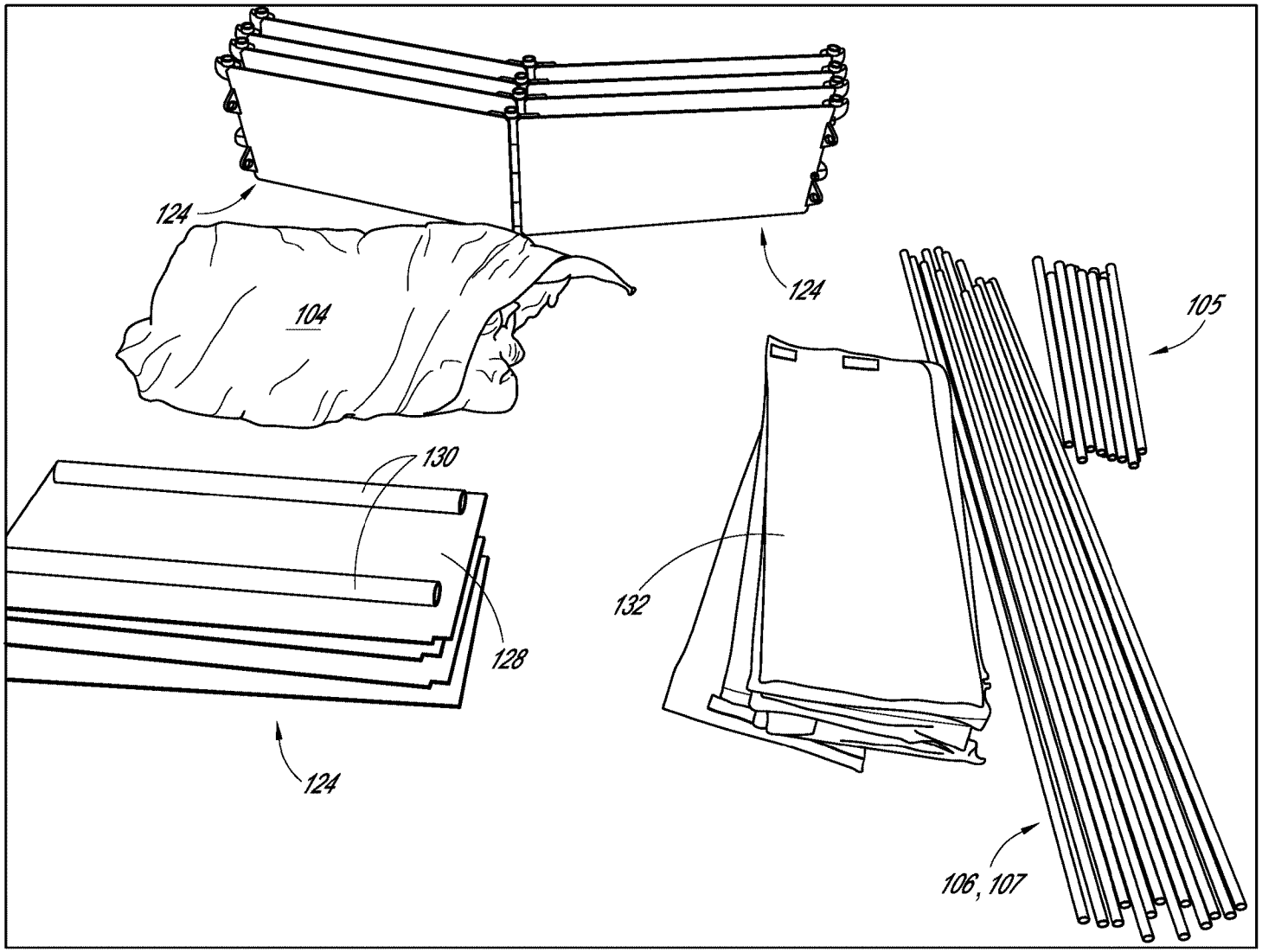
FIG. 2 is a disassembled view of the components of the portable modular antenna enclosure of FIG. 1.

FIG. 2 illustrates some of the components of the modular antenna enclosure 100. As shown, the base of the modular antenna enclosure 100 can include a plurality of side plates 124. The side plates 124 can include a flat panel member 128 and one or more reinforcing tube members 130 that can be welded or otherwise connected to the flat panel members 128. In any arrangements, the reinforcing tube members 130 can be integrally formed with the flat panel members 128, or can be modular and attachable to the flat panel members.

In any arrangements, the dimensions of the flat panel member 128 can vary to accommodate antennae of different sizes. The height of the flat panel member 128 can range between approximately 6 inches and approximately 36 inches. The width of the flat panel member 128 can be between approximately 24 inches and approximately 36 inches. The flat panel members 128 can have a thickness between approximately 0.25 inches and approximately 0.50 inches. In any arrangements disclosed herein, the flat panel members 128 can be approximately 30 inches wide and approximately 12 inches in height. In any arrangements disclosed herein, the flat panel members 128 can have a thickness of approximately 0.50 inches.

The flat panel members 128 of any aspects of the support structure can optionally be, though not required to be, made of materials such as plastic, including ABS, polypropylene, PVC, fiber based composite materials, any combinations of the forgoing and/or any other suitable materials. In any arrangements of the enclosure 100, the flat panel members 128 can be lightweight yet rigid and strong enough to provide sufficient structural support to the enclosure 100 such that the enclosure 100 is able to withstand harsh environments (for example, rain, sleet, winds as high as 85 mph) without collapse. The side panels 124 can also be configured to be easy to handle and assemble, making the enclosure easier to transport and assemble.

In any arrangements, the dimensions of the reinforcing tube members 130 can vary, though not required, to accommodate antennae of different sizes. Optionally, the dimensions of the reinforcing tube members 130 can vary to accommodate the flat panel member having different dimensions. The reinforcing tube members 130 can have a length ranging between approximately 24 inches and approximately 36 inches. The reinforcing tube members 130 can have a diameter ranging between approximately 1 inch and approximately 2 inches. In any arrangements disclosed herein, the reinforcing members 130 can be approximately 32 inches in length and approximately 1.25 inches in diameter. Optionally, the reinforcing members 130 can optionally be made out of aluminum. The reinforcing tube members can be, though not required to be, made of materials that can be lightweight and strong enough to withstand harsh environments as noted above. Additionally and/or optionally, the reinforcing members 130 can be coated or sprayed with radio-frequency (RF) absorbent material.

In any arrangements, the support members 105, 106, 107 can be disassembled and stored or shipped in small volumes. The outside of the panel members 128 can be covered by fabric cover members 132 that are attached to each other by fasteners such as hook and loop fasteners. The fabric cover members 132 can be interconnected to the cover 104 via similar fasteners. In some arrangements, the fabric cover members 132 can be integrated to the cover 104.

Figure 2A:
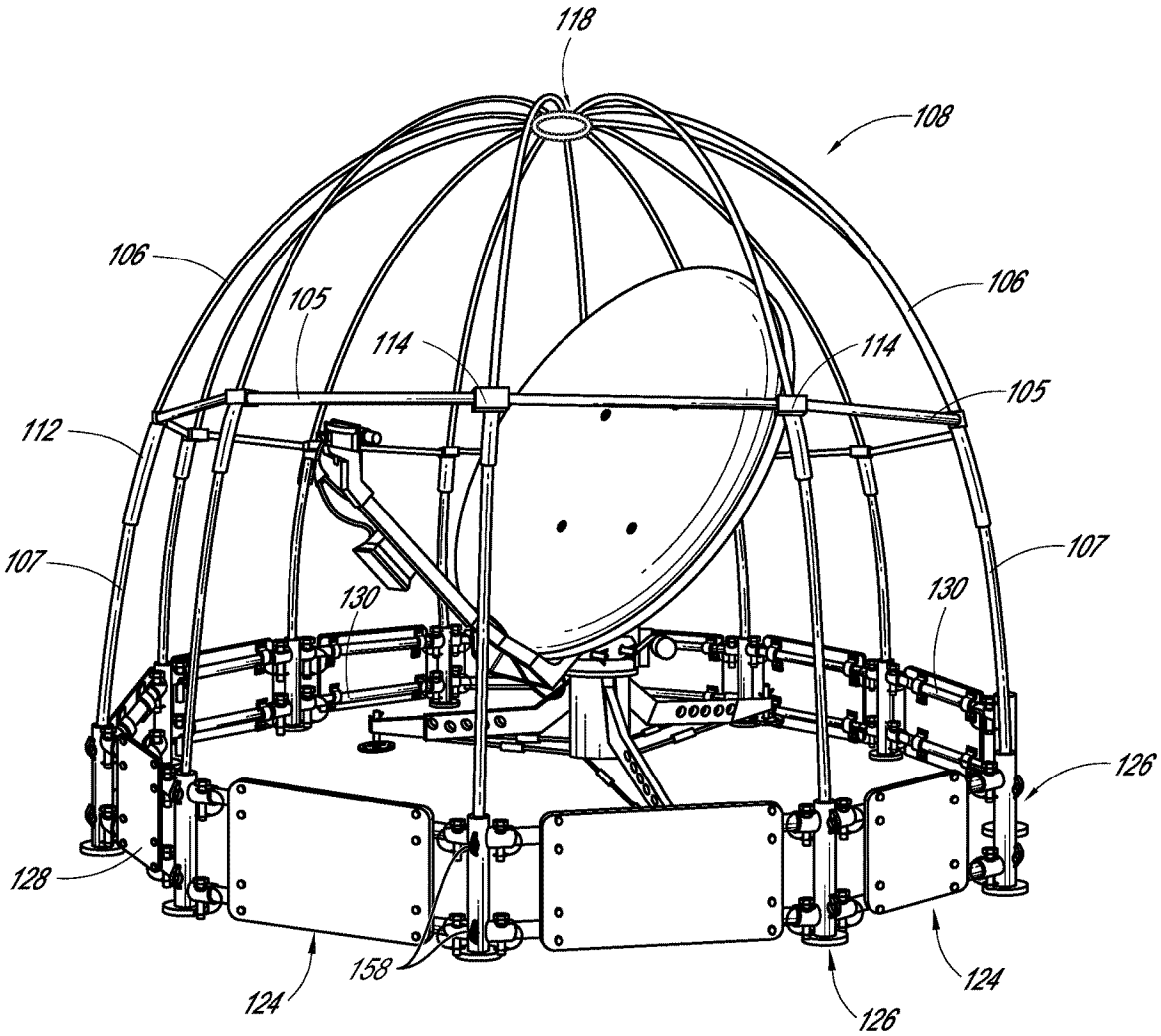
FIG. 2A is a perspective view of a modular antenna enclosure without a cover.

FIG. 2A illustrates the modular antenna enclosure 100 without the cover 104. In any arrangements, the modular antenna enclosure 100 and can include one or more of the side plates 124 and one or more of the base stands 126. In any arrangements disclosed herein, the base of the modular antenna enclosure 100 can include twelve side plates 124 and twelve base stands 126. Optionally, the base of the modular antenna 100 can include less than or greater than twelve side plates 124 and twelve base stands 126. Optionally, the base of the modular antenna 100 can have the same or different number of side plates 124 and base stands 126.

In some arrangements, the enclosure 100 can have a diameter ranging between approximately eight feet and approximately fifteen feet. In other arrangements, the enclosure 100 can be approximately thirty feet in diameter. In some arrangements the height of the modular antenna enclosure 100 can vary between approximately ten feet and twenty feet. Optionally, the height of the modular antenna enclosure 100 can be approximately fifteen feet.

Optionally, the base stands 126, the side plates 124, the support members 105, 106, 107, and capture member 118 can be numbered to assist assembly of the modular antenna enclosure 100. In some arrangements, the base stands 126, the side plates 124, the support members 105, 106, 107, and the capture member 118 can be color coordinated to assist users in assembling the antenna enclosure 100.

As described, the antenna enclosure 100 can include the frame structure 108 that can include a plurality of vertical support members 106, 107 and a plurality of the horizontal support members 105. In any arrangements, as shown in FIG. 2A, the lower vertical support members 107 can be removably coupled to the base stands 126 while the upper vertical support members can be removably coupled to the capture member 118. The capture member 118 can be made of materials that are lightweight yet rigid and strong. In some arrangements, the capture member 118 and any other components of the frame structure disclosed herein can be made of high density polyethylene (HDPE). The horizontal support members 105 can be positioned between and removably coupled to adjacent vertical support members 106, 107. Since the vertical support members 106, 107 can be made of flexible, lightweight, yet rigid material as described above, coupling the horizontal support members 105 to the vertical support members 106, 107 can prevent the vertical support members 106, 107 from bending in directions substantially orthogonal to their lengths and provide stability for the frame structure 108.

Optionally, the vertical support members 106, 107 can couple in series between the base stands 126 and the capture member 118 using connectors 114. In some arrangements, the vertical support members 106, 107 can be coupled in series using a sleeve 112. The sleeve 112 can slidingly receive ends of the vertical support members 106, 107. The connector 114 can slidingly couple with or receive the sleeve 118. In some arrangements, the lower vertical support member 107 can be coupled to the base stand 126 and the connector 114 or the sleeve 112. The upper vertical support member 106 can be coupled to the connector 114 or the sleeve 112 and the capture member 118 such that the upper vertical support member 106 is in series with the lower vertical support member 107. Alternatively, the vertical support members 106, 107 can extend between the base stand 126 and the capture member 118 as one component, thereby not requiring the connectors 114.

Optionally, the vertical support members 106, 107 can have the same or different lengths. The lower vertical support members 107 can be between approximately 20 inches and approximately 40 inches in length. In any arrangements disclosed herein, the lower vertical support members 107 can be approximately 34 inches long. The upper vertical support members 106 can be between approximately 60 inches and approximately 100 inches in length. In any arrangements disclosure herein, the upper vertical support members 106 can be approximately 81 inches in length.

Optionally, the support members 105, 106, 107 can include indicators that represent that the support members 105, 106, 107 are inserted all the way into the capture member 118, the sleeves 180, and/or the connectors 114. For example, the users can insert the upper vertical support members 106 into openings of the capture member 118 until the indicator is aligned with the opening. Such feature can advantageously allow the users to insert the support members 106 to a recommended depth into the openings of the capture member 118 (or openings of the sleeves 180 or that of the connectors 114).

In some arrangements, the horizontal support members 105 can be coupled to either or both of the upper or lower vertical support members 106, 107 via the connectors 114. The connectors 114 can include one or more openings that can frictionally engage and couple with ends of the horizontal and vertical support members 105, 106, 107. Optionally, the connectors 114 and the horizontal support members 105 can be positioned between approximately 30% and approximately 70% of the height of the modular antenna enclosure 100. In some arrangements, the connectors 114 and the horizontal support members 105 are positioned between approximately 50% and approximately 60% of the height of the modular antenna enclosure 100.

Figure 2B:
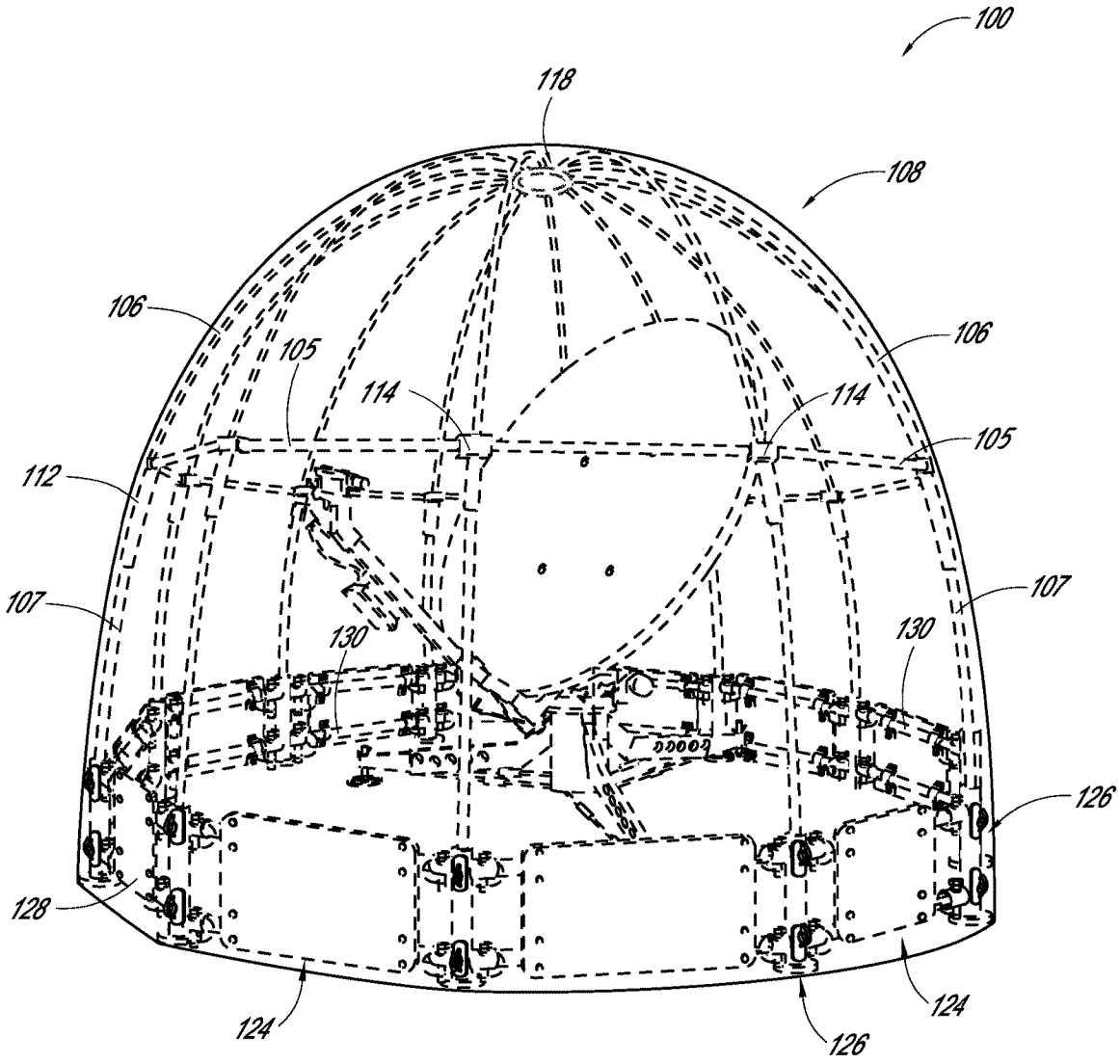
FIG. 2B is a perspective view of the modular antenna enclosure of FIG. 2A with a cover.

FIG. 2B illustrates the modular antenna enclosure 100 of the FIG. 2A with the cover 104. In some arrangements, the cover 104 can drape the frame structure 108, the side plates 124, and the base stands 126. The cover 104 can be removably coupled to various components of the modular antenna enclosure 100 as further described below.

Figure 3:
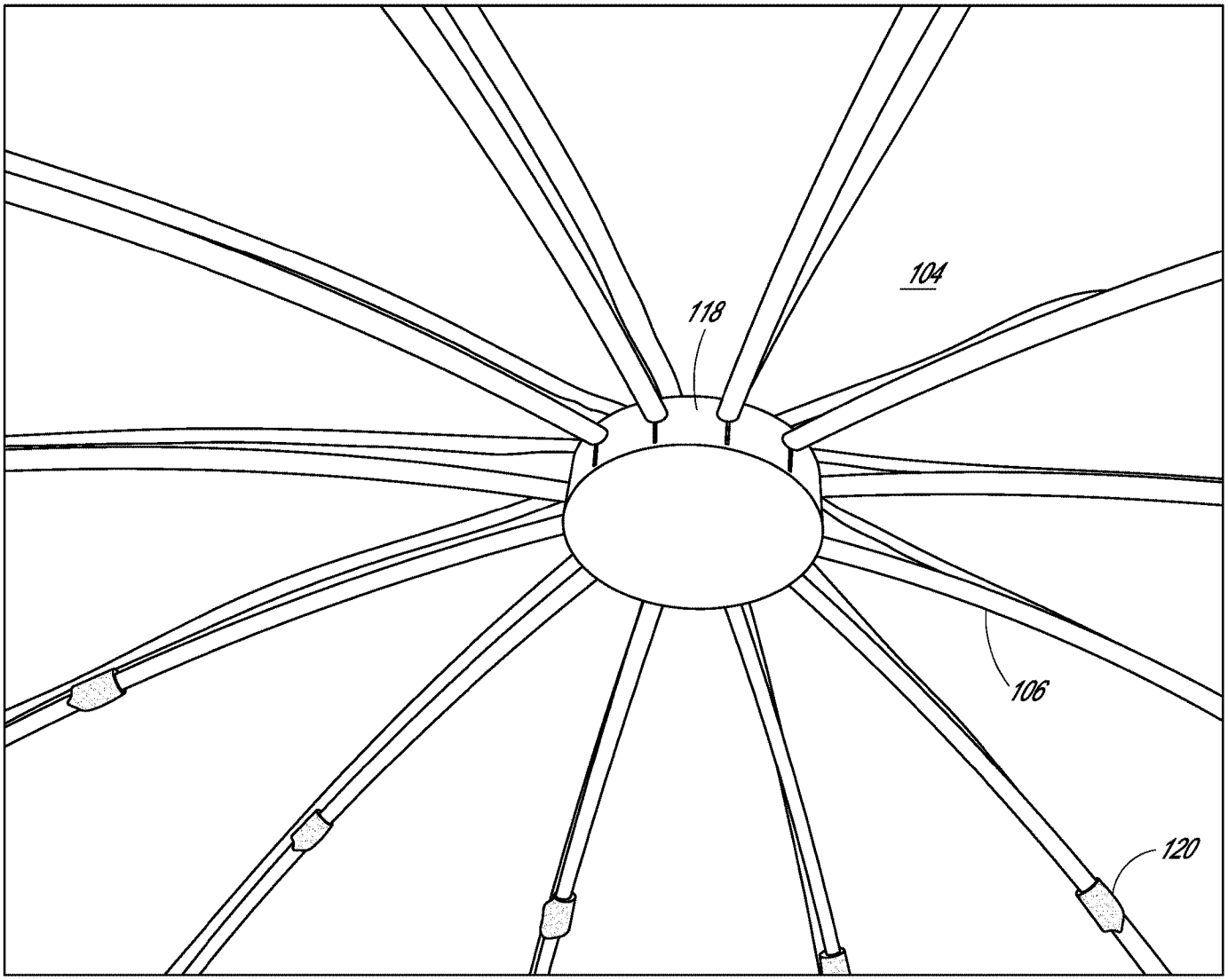
FIG. 3 is a view of an example interior upper portion of the antenna enclosure of FIG. 1.

As is shown in FIG. 3, the capture member 118 can, though not required to, include openings that receive upper ends of the upper vertical support members 106. The openings can be formed on the side of the capture member 118 such that they are horizontally oriented. The capture member 118 can be positioned about a top of the modular antenna enclosure 100. The openings of the capture member 118 can frictionally engage the ends of the upper vertical support members 106. In some arrangements, the capture member 118 can include additional securing devices to secure the upper ends in the upper vertical support members 106.

As shown in FIG. 3, hook and loop fasteners 120 can attach to the inside of the cover 104 to secure the cover 104 to the vertical support members 106, 107 and/or horizontal support members 105. Other fasteners can also be used for this purpose without departing from the scope of the present teachings.

In some arrangements, the cover 104 can be draped over the frame structure 108 such that the vertical support members 106 and the horizontal support members 105 can abut and support an inner surface of the cover 104. The support members 105, 106, 107 can allow the cover 104 to have a smooth outer surface, which can protect an antenna placed inside the modular antenna enclosure 100 from various harsh environments such as high wind, frigid conditions, hot conditions, dusty environments, and the like. For example, in rainy conditions, the smooth surface of the cover 104 can prevent pooling of rain water that can negatively affect (for example, reflect, attenuate, and the like) signals from the antenna. In another example, the smooth surface can aid in preventing snow from accumulating on top of the cover 104, which can cause stress on the frame structure 108. In some arrangements, the support structures 105, 106, 107 can allow the cover 104 to assume a substantially dome-like shape having an aerodynamic profile. Such aerodynamic profile can reduce wind load exerted on the modular antenna enclosure 100 and can allow the antenna enclosure 100 to withstand winds up to 85 MPH.

In some arrangements, the cover 104 can be coated or treated with hydrophobic materials that can prevent pooling of water or water collecting on the outer surface of the cover 104. Optionally, the cover 104 can be made out of a hydrophobic material such as PTFE fabric that is PTFE coated and the like. Additionally and/or alternatively, the cover 104 can be coated or treated with hydrophobic materials. Such hydrophobic materials can be applied to the cover 104 in various methods such as spraying, painting, dipping, adhering, any combinations of the forgoing and/or any other suitable materials.

Additional and/or alternatively, the cover 104 can be made of RF transparent material that allows transmission of RF signal (that is, allow penetration of RF signal without reflection and/or absorption) through the cover 104. This can be advantageous in maintaining quality of signal transmitted from an antenna housed by the modular antenna enclosure 100. By reducing the amount of RF signal reflected and/or absorbed (and thereby allowing more RF signal through), the cover 104 can provide improved signal quality. In this regard, the cover 104 can allow an antenna housed within the modular antenna enclosure 100 to track satellites without needing an opening in the cover 104 because the cover 104 can be made of RF transparent material. Since the modular antenna enclosure 100 does not require an opening in the cover 104, the enclosure 100 permits coverage of (for example, for signal transmission) 180 degree range in altitude and 360 degree range in azimuth.

Optionally, the cover 104 can include an access flap that can function as a door or an opening for the modular antenna enclosure 100. The access flap can be made of the same material as the rest of the cover 104. The access flap can include a mechanism such as hook and loop, Velcro, and the like to keep the access flap closed.

Figure 4A:
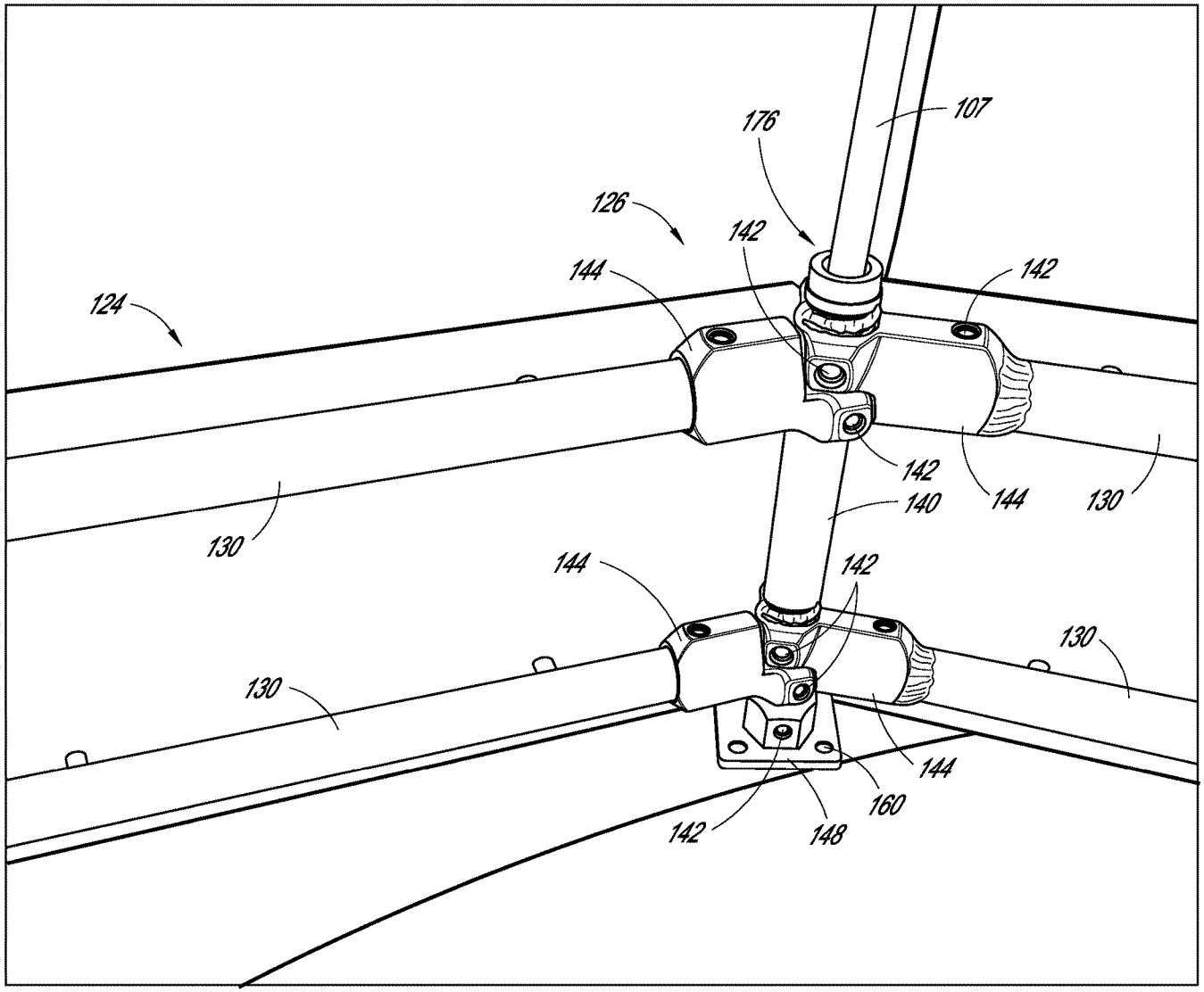
FIG. 4A is a view of an example interior lower portion of the antenna enclosure of FIG. 1.

Referring now to FIG. 4A, the side plates 124 can be interconnected together by base stands 126. The base stands 126 can be positioned between adjacent pairs of the side plates 124. The base stands 126 can, optionally (that is, not required to), include a tube 140 that can receive the lower vertical support members 107. Set screw tensioners 142 can be used to secure the lower vertical support members 107 to the tube 140. In some arrangements, the tube 140 can be substantially vertical.

The base stands 126 can include connectors 144 that can receive the ends of the reinforcing members 130. In some arrangements, the reinforcing member 130 can be secured to the connectors 144 also with set screw tensioners 142 or similar fasteners including without limitation pins, ball and detent arrangements, and/or other suitable securing elements. In this manner, each of the side plates 124 can be securely but removably coupled with to the other, adjacent side places 124 and the frame 108 via the base stands 126.

When the upper vertical support members 106 are coupled with the capture member 108 and the tubes 140 of the base stands 126, the upper vertical support members 106 can extend between the capture member 108 and the tubes 140 in an arcuate or curved arrangement, as shown in FIG. 1. In some arrangements, the lower vertical support members 107 can be substantially vertically orientated at the tubes 140 while the upper vertical support members 106 can be substantially horizontally orientated at the capture member 108.

As is also shown in FIG. 4A, the base stands 126 can include a floor securing member 148 attachable to a ground or surface. The floor securing members 148 can be used to secure the base stands 126 a surface below. In this regard, the base stands 126, the side plates 124, and the frame structure 108 can be secured. The floor securing member 148 can include a plurality of apertures 160 that can be used to fixedly couple the floor securing member 148 to a surface. The apertures 160 can be circular to accommodate various types of screws, nails, stakes, or any similar or suitable fasteners.

Optionally, the base stands 126 can include a connector 176 positioned about a top of the tube 140. The connector 176 can be rotatable to securely fix the lower vertical support members 107 in the tube 140. In some arrangements, the connector 176 can have a first configuration and a second configuration, where the connector 176 in the first configuration allows the lower vertical support members 107 to be inserted into the tube 140 and the connector 176 in the second configuration secures the lower vertical support members 107 positioned in the tube 140.

Figure 4B:
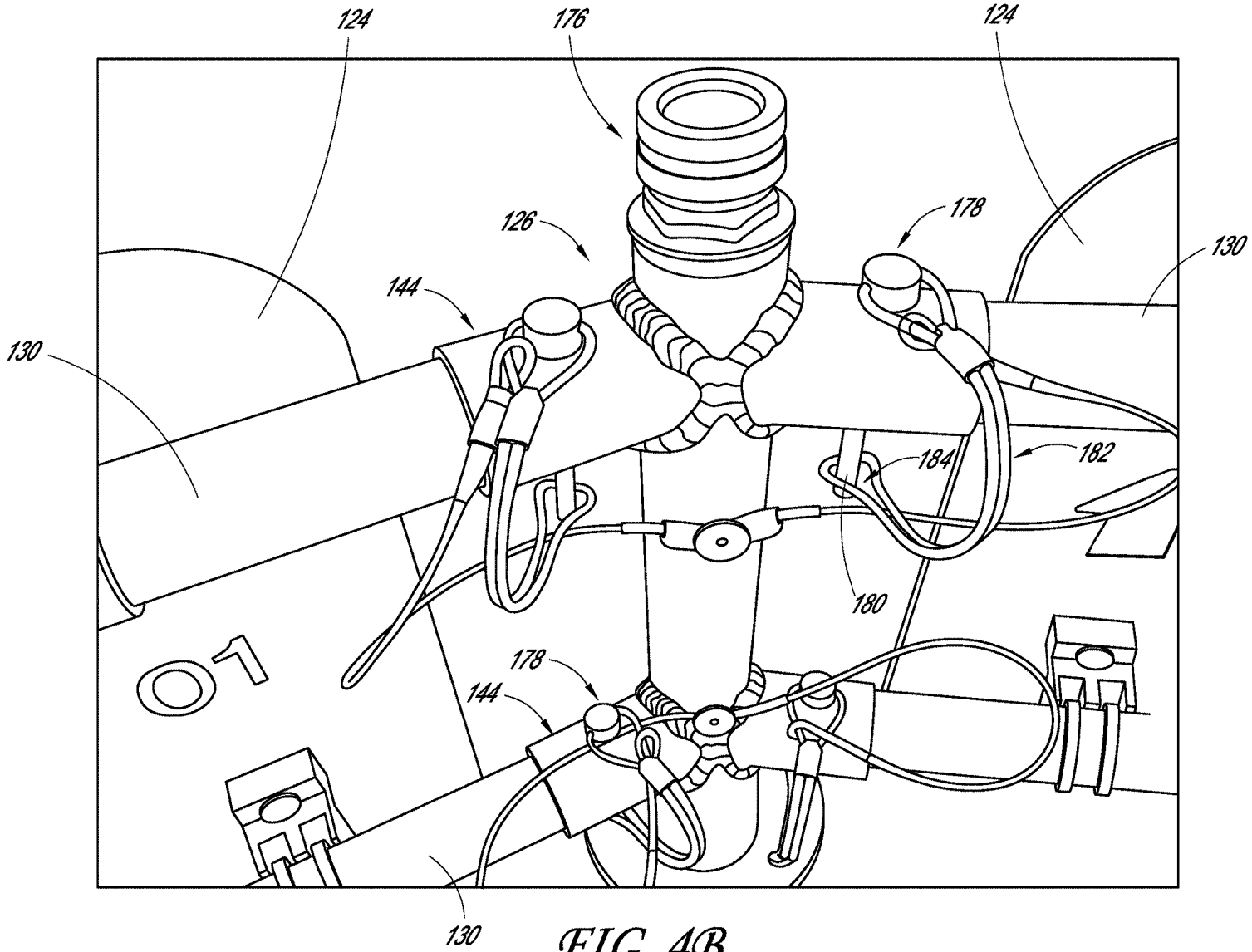
FIG. 4B illustrates a view of another example interior lower portion.

FIG. 4B illustrates another optional example of the base stands 126 and the side plates 124. In the arrangement shown in FIG. 4*b*, the base stands 126 and the side plates 124 can be coupled using locking pins 178. The locking pins 178 can be tethered to the base stands 126. The locking pins 126 can include an elongated portion 180 that can extend through one or more openings formed on the connectors 144 and the reinforcing members 130. The one or more openings formed on the connectors 144 and the reinforcing members can be aligned such that the elongated portion 180 of the locking pins 178 can extend through the one or more openings. In some arrangements, the one or more openings of the connectors 144 and the reinforcing members 130 can be aligned in a vertical orientation. Once inserted, the elongated portion 180 of the locking pins 178 can removably secure the base stands 126 and the side plates 124 together.

Optionally, the locking pins 178 can include a clasp 182. The clasp 182 can include an opening 184 that can hold an end of the elongated portion 180 in place. Once the locking pins 178 are secured within corresponding openings of the connectors 144 and the reinforcing members 130, the opening 184 of the clasp 182 can receive a free end of the elongated portion 180. Once the free end of the elongated portion 180 is received by the opening 184, the claps 182 can prevent accidental dislodging of the locking pin 178 from the openings of the connectors 144 and the reinforcing members 130. The clasp 180 can be dimensioned and shaped such that the locking pin 172 can be removed from the openings of the connectors 144 and the reinforcing members 130 when the free end of the elongated portion 180 is not received by the opening 184.

Figure 5:
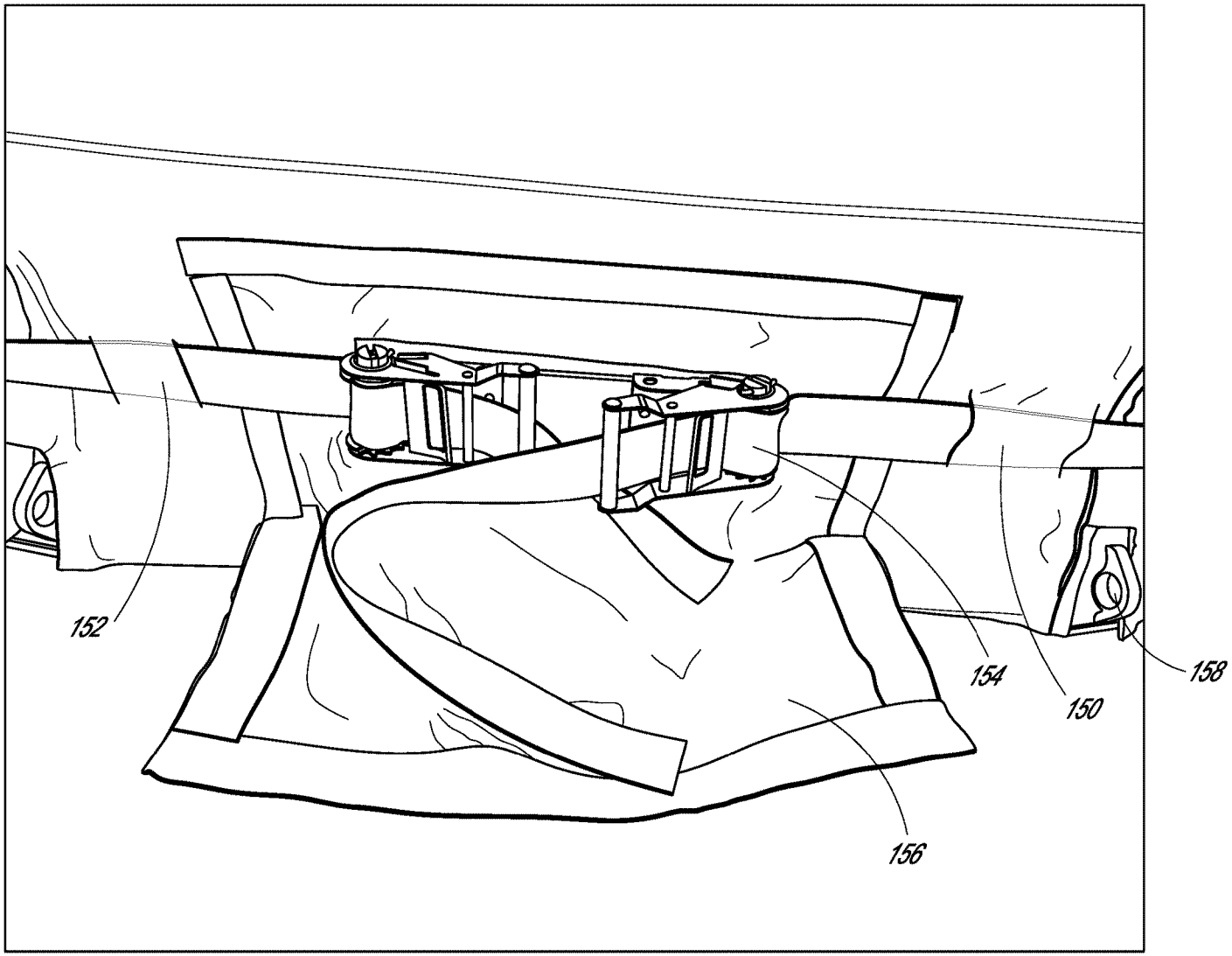
FIG. 5 is a view of the exterior lower portion of the antenna enclosure of FIG. 1.

FIG. 5 illustrates an example method of securing the cover 104. As discussed above, the cover 104 can be positioned over the frame structure 108. Bottom edges of the cover 104 can cover the side plates 124 and the base stands 126 as shown in FIGS. 2A and 2B. As shown in FIG. 5, the cover 104 can include loops 150, openings, or pockets that the strap 152 can extend through so that the strap can be cinched or tightened around and/or against the side plates 124. The strap 150 can extend around all or a portion of the outer perimeter of the cover 104 near a bottom portion of the cover 104. The enclosure 100 can include a ratcheting tensioner 154 to tighten the strap 152 around the cover 104 to secure the cover 104 to the frame structure 108. As shown, the tensioner 154 can be positioned within inside a pouch 156.

The base stand 126 may also include additional anchor members 158 that can protrude through the cover to provide additional anchor points for the assembly 100. For example, the anchor members 158 can include eye bolts integrated with one or more of the base stands 126. The anchor members 158 can be tethered to a support member fixed to an external location (for example, concrete base, ground including dirt, and the like) to provide additional support for the modular antenna enclosure 100. Optionally, ballast weight can be tethered or attached to the anchor members 158 to provide additional support for the modular antenna enclosure 100. The ballast weight attached to each of the base stands 126 can range between approximately 50 lbs and approximately 200 lbs. The ballast weight can allow the modular antenna enclosure 100 to withstand windy conditions with greater wind speed.

Optionally, the cover 104 can be removably coupled to the side plates 124 and/or the base stands 126. In some arrangements, the cover 104 and the side plates 124 can include, for example, hook fasteners, or otherwise to removably fix the cover 104 to the side plates 124. In other arrangements, the cover 104 can be coupled to the anchor members 158 of the base stands 126. For example, the cover 104 can include a rope that can tether to the anchor members 158.

Figure 6:
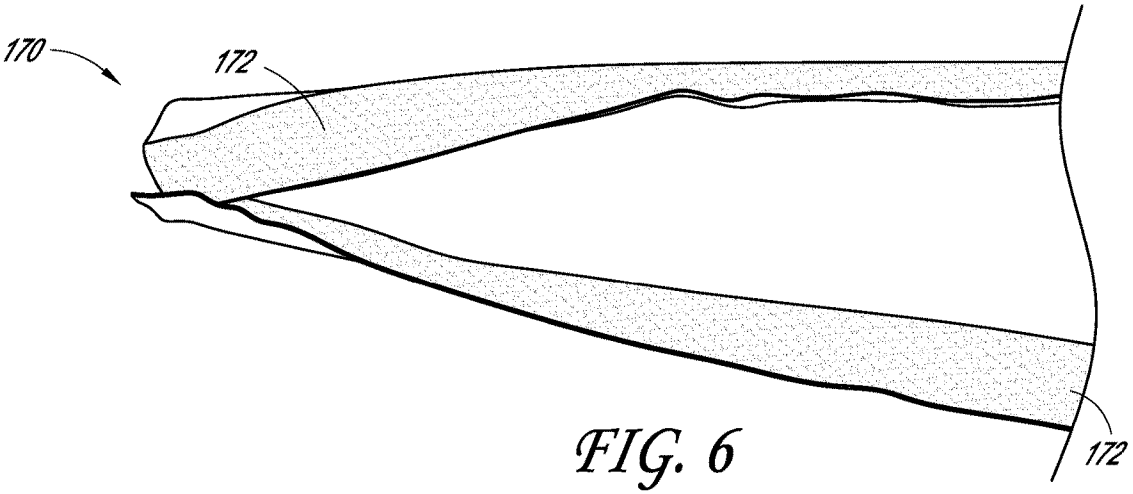
FIG. 6 is a view of an example radio frequency (RF) absorbent sheet having a coupling mechanism.
Figure 7:
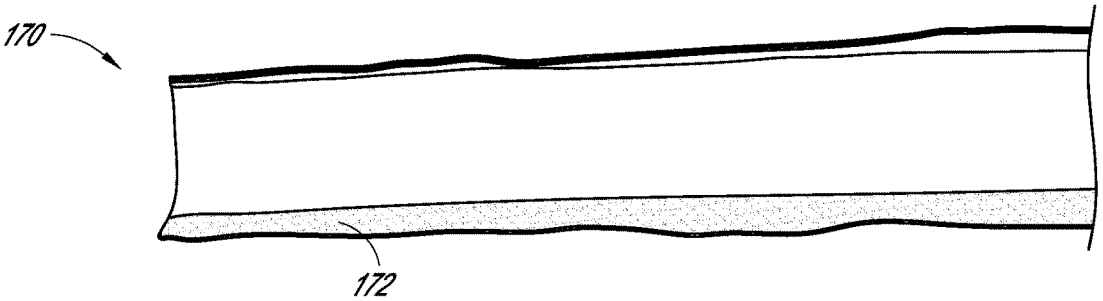
FIG. 7 is a view of an example RF absorbent sheet in an open configuration.
Figure 8:
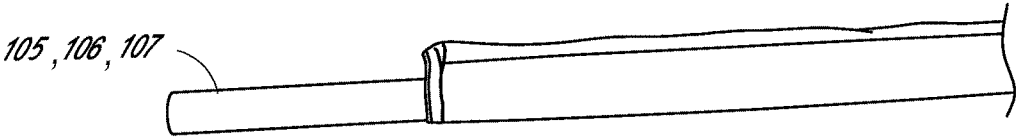
FIG. 8 is a view of an example RF absorbent sheet in a closed configuration wrapped around a support member.

Referring now to FIGS. 6-8, a signal absorbing shield 170 that can be used to cover one or more of the support members 105, 106, 107 is shown. As discussed above, the support members 105, 106, 107 can be made of fiberglass, which if unshielded, can reflect RF signal transmitted by an antenna placed under the modular antenna enclosure 100. The signal absorbing shield 170 can prevent the support members 105, 106, 107 from reflecting the RF signal from the antenna back at the antenna. The signal absorbing shields can, thus, advantageously improve the signal transmitted by and to the antenna.

The signal absorbing shield 170 can include fasteners 172. The fasteners 172 can secure the signal absorbing shield 170 to the support members 105, 106, 107. The fasteners 172 can be, though not required, positioned at opposing ends of the signal absorbing shield 170, as shown in FIG. 6. Various types of fastening mechanisms can be used for the signal absorbing shield 170 including, without limitation, Velcro loop and hook, stitching, straps, and the like, or any combination of the foregoing fastening mechanisms. The signal absorbing shield 170 can surround all or a portion of the support members 105, 106, 107, connectors 114, and/or sleeves 112. In any arrangements, the signal absorbing shield(s) (which are also referred to herein as wraps) can cover an inside surface of the support members 105, 106, 107, the connectors 114, and/or the sleeves 112 only. In any arrangements, the signal absorbing shield 170 can cover an inside surface only of the support members 105, 106, 107, the connectors 114, and/or the sleeves 112.

The signal absorbing shield 170 can be slidingly coupled to the support members 105, 106, 107. In some arrangements, the signal absorbing shield 170 can be removably coupled to the reinforcing tube members 130.

The signal absorbing shield 170 can be made out of or coated with RF absorbent material. The RF absorbent material can be made materials that is water-resistant or waterproof, repels moisture, and has high dielectric strength. Additionally and/or alternatively, the RF absorbent material can have high impact, flexural, tensile, and/or compressive strength to allow the signal absorbing shield 170 to be high impact resistant. Other types of composite materials with suitable properties can be used for the signal absorbing shield 170. The RF absorbent material can be MAS-300 series RF absorber material manufactured by MWT Materials™.

In some arrangements, the signal absorbing shield 170 can include a fabric with the RF absorbent material sewn onto the fabric. The signal absorbing shield 170 can include magnetic radar absorbing materials in different forms (for example, film, sheet, coating, or powder). In any arrangements disclosed herein, all of the support members 105, 106, 107 and/or any of the other components or portions of the frame structure 108 can be wrapped in or fully or partially covered by the signal absorbing shield 170.

Optionally, some components of the antenna enclosure 100 can be modular and thus more easily transported and assembled. The enclosure 100 can be easily assembled. Once assembled, the base stands 126 can optionally be securely fastened to the frame structure 108. The cover 104 can be securely fastened to the frame structure 108 and the side plates 124. Arrangements of the enclosure 100 disclosed herein can maintain its structural integrity even in wind speeds as high as 85 miles per hour.

Figure 9:
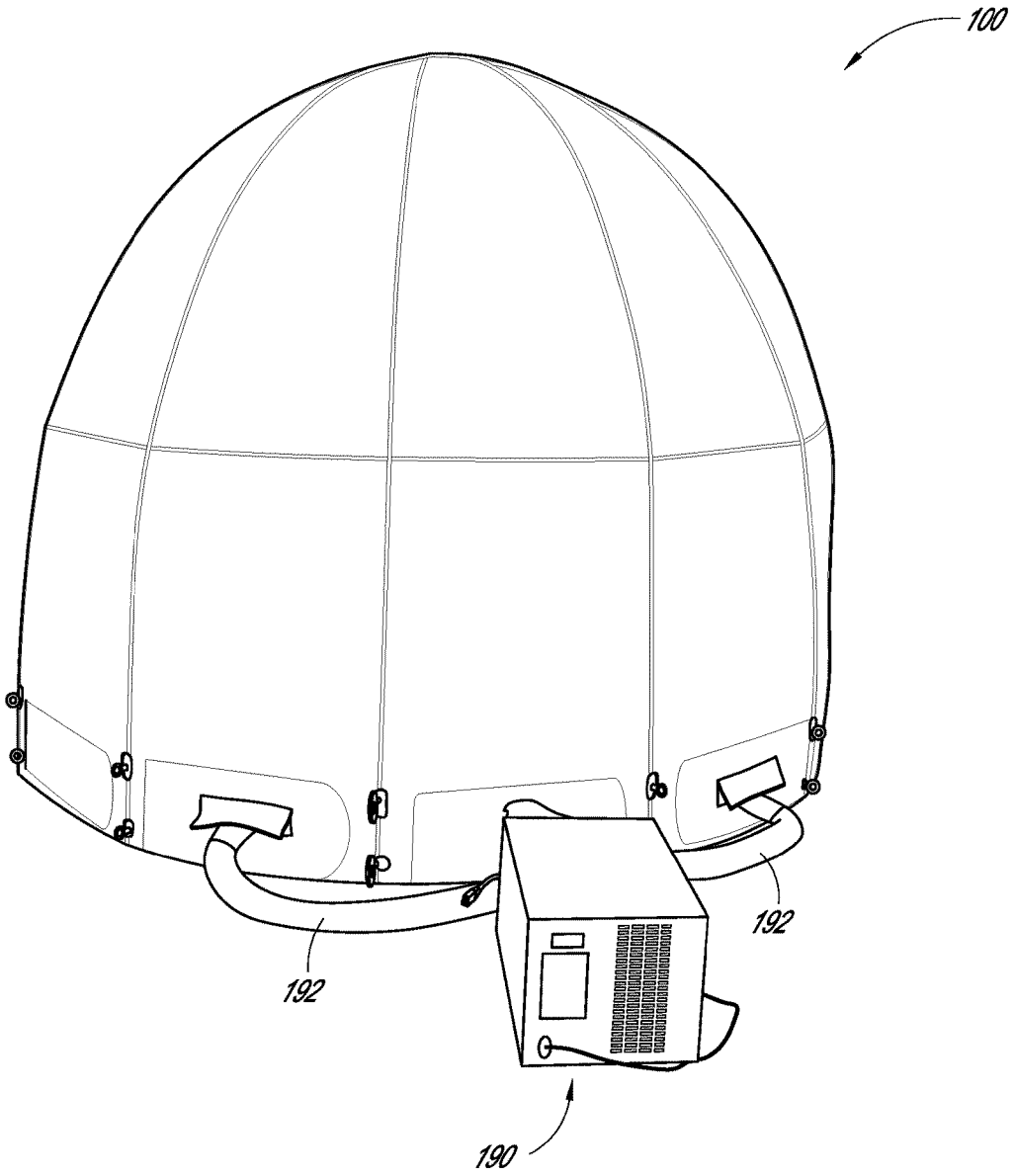
FIG. 9 illustrates a perspective view of a portable, modular antenna enclosure with an environmental control unit.

FIG. 9 illustrates an example modular antenna enclosure 100 with an environmental control unit (ECU) 190. The ECU 190 can include one or more ducts 192 coupled to one or more of the side plates 124. For example, the ECU 190 can include two ducts 192 where one of the ducts functions as an intake duct and the other functions as an outtake duct. Optionally, the ECU 190 can include only one duct 192. In some arrangements, the side plates 124 can include openings that can slidingly receive the ducts 192. Optionally, the side plates 124 can include openings for routing electrical connections for the ECU 192. Such openings can allow the ECU 190 to receive power from a power source that can be placed within a space inside the modular antenna enclosure 100.

The ECU 190 can function as a heater or an air conditioning unit. In cold environments, the ECU 190 can function as a heater that can prevent ice build-up on the can be advantageous because ice can reflect communications signals, which can attenuate or reduce the quality of signal received or transmitted by an antenna housed within the modular antenna enclosure 100. In hot environments, the ECU 190 can function as an air conditioning unit that can prevent equipment housed within the modular antenna enclosure 100 from overheating.

Optionally, the ECU 190 can include a step-down or step-up transformer that can increase or decrease the voltage supplied to the ECU 190. This can be advantageous to allow user to use the ECU 190 in areas or countries that supply alternating current with different voltage.

Optionally, the ECU 190 can be positioned outside the modular antenna enclosure 100.

Although the foregoing has shown, illustrated and described one arrangement of the instant application, various changes, modifications, and substitutions as well as changes in usage may be made by those skilled in the art. As such, the scope of the instant application should not be limited to the foregoing description of an arrangement of this invention but should encompass all such changes, modifications, substitutions and changes in usage.

An example modular antenna enclosure 100 can have any of the other features, components, or other details of any of the other catheter arrangements disclosed herein, in combination with or in place of any of the features, components, or other details disclosed with respect to the modular antenna enclosure 100 to form new catheter arrangements. Similarly, any of the other arrangements of the modular antenna enclosure 100 disclosed herein can have any of the features, components, or other details described herein with respect to modular antenna enclosure 100 in combination with or in place of any of the features, components, or other details disclosed with respect to the arrangements of the other modular antenna enclosure 100.

While certain arrangements of the inventions have been described, these arrangements have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing arrangements. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate arrangements can also be implemented in combination in a single arrangement. Conversely, various features that are described in the context of a single arrangement can also be implemented in multiple arrangements separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other arrangements. Those skilled in the art will appreciate that in some arrangements, the actual steps taken in the processes illustrated and/or disclosed may differ from those shown in the figures. Depending on the embodiment, certain of the steps described above may be removed, others may be added. Furthermore, the features and attributes of the specific arrangements disclosed above may be combined in different ways to form additional arrangements, all of which fall within the scope of the present disclosure. Also, the separation of various system components in the arrangements described above should not be understood as requiring such separation in all arrangements, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain arrangements include, while other arrangements do not include, certain features, elements, and/or steps. Thus, such conditional language is not generally intended to imply that features, elements, and/or steps are in any way required for one or more arrangements or that one or more arrangements necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain arrangements require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain arrangements, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred arrangements in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A portable antenna enclosure for a communications antenna, comprising:

a cover configured to form a complete above-ground enclosure around a communications antenna when the enclosure is in an assembled state;

a modular frame configured to support the cover out of contact with a communications antenna positioned within the enclosure in the assembled state, the frame being positioned inside of the cover in the assembled state, the frame comprising:

a plurality of upper support members configured to support an upper portion of the enclosure in the assembled state; and a plurality of shield elements configured to cover at least an inward facing surface of at least one of the plurality of upper support members;

wherein:

a lower portion of the frame is configured to rest on a support surface when the enclosure is in an assembled state; and the plurality of shield elements are configured to reduce an amount of radio-frequency signal reflectable by at least one of the plurality of upper support members when the enclosure is in the assembled state.

2. The antenna enclosure of claim 1, wherein the upper support members are made from a resilient, flexible material and are configured to be supported in a bent state when the frame is in the assembled state.

3. The antenna enclosure of claim 1, wherein the frame further comprises a plurality of side plates positioned in a circumferential arrangement in a lower portion of the frame in an assembled state, the plurality of side plates being configured to increase the structural stability of the frame.

4. The antenna enclosure of claim 3, wherein the frame further comprises a means for coupling the plurality of side plates together and to the frame.

5. The antenna enclosure of claim 1, wherein a lower portion of the frame comprises a plurality of interconnected side plates in a circumferential arrangement.

6. The antenna enclosure of claim 1, wherein the cover is configured to permit a near complete transmission of a communications signal through the cover such that the communications antenna is highly efficient in transmitting the communications signal through the cover even when the cover completely encloses the communications antenna.

7. The antenna enclosure of claim 1, wherein the cover is made from polytetrafluoroethylene.

8. The antenna enclosure of claim 1, wherein the plurality of shield elements comprise a material configured to suppress near field microwave surface currents over a frequency range of 0.01 to 16 GHz.

9. The antenna enclosure of claim 1, further comprising a means for coupling the frame to a ground surface.

10. The antenna enclosure of claim 1, further comprising a means for coupling the cover with the frame.

11. The antenna enclosure of claim 1, wherein the cover comprises a plurality of loops configured to receive a strap, the strap being configured to tighten the cover against an outside surface of the frame.

12. The antenna enclosure of claim 1, further comprising an environment control unit configured to prevent a formation of ice on an outer surface of the cover.

13. The antenna enclosure of claim 1, wherein the enclosure is configured to be assembled without a use of any tools.

14. The antenna enclosure of claim 1 and a communications antenna.

15. An assemblable, lightweight antenna enclosure configured to protect an antenna from harsh environments, the enclosure comprising:

a frame comprising:

a plurality of side plates each comprising a panel member and a reinforcing member, the reinforcing member connected to the panel member;

a plurality of side plate connectors, each of the plurality of side plate connectors being positioned between each of the plurality of side plates, each of the plurality of side plate connectors configured to selectively couple the plurality of side plates together by receiving corresponding reinforcing members of the plurality of side plates when the enclosure is in an assembled state; and a plurality of vertical support members, each of the plurality of vertical support members comprising a first vertical support member and a second vertical support member, the first vertical support member and the second vertical support member coupled via a support member connector when the frame is in the assembled state, the first vertical support member and the second vertical support member being coupled in series; and a cover configured to cover the frame and to form a complete enclosure around an antenna.

16. The antenna enclosure of claim 15, wherein the panel member is a rigid flat panel, and wherein the reinforcing member is a rigid elongated tubular member.

17. The antenna enclosure of claim 15, wherein each of the connectors of the plurality of side plate connectors comprise a securing element configured to secure the connection between the plurality of side plates and the plurality of side plate connectors.

18. The antenna enclosure of claim 3, wherein:

the frame further comprises a plurality of side plate connectors, each of the plurality of side plate connectors positioned between each of the plurality of side plates; and the plurality of side plate connectors configured to selectively couple the plurality of side plates together by receiving corresponding reinforcing members of the plurality of side plates when the enclosure is in an assembled state.

19. The antenna enclosure of claim 18, wherein the reinforcing members of the plurality of side plates are rigid elongated tubular members connected to panel members of the plurality of side plates.

20. The antenna enclosure of claim 15 further comprising a plurality of shield elements configured to cover at least the inward facing surfaces of the plurality of vertical support members, wherein the plurality of shield elements are configured to reduce an amount of radio-frequency signal reflectable by the plurality of vertical support members.

* * * * *